US005566941A

United States Patent [19]

Destics

[11] Patent Number: 5,566,941

[45] Date of Patent: Oct. 22, 1996

[54] SPHERICAL PUZZLE

[76] Inventor: Rudolf Destics, 1125 South St., Niles, Mich. 49120

[21] Appl. No.: 501,501

[22] Filed: Jul. 12, 1995

[51] Int. Cl.[6] ..... A63F 9/08

[52] U.S. Cl. ..... 273/153 S

[58] Field of Search ..... 273/153 R, 156, 273/155, 153 S

[56] References Cited

U.S. PATENT DOCUMENTS

| | | | |
|---|---|---|---|
| 3,081,089 | 3/1963 | Gustafson | 273/155 |
| 4,454,454 | 6/1984 | Greene | 273/153 S |
| 4,557,484 | 12/1985 | Sherman, Jr. et al. | 273/153 S |
| 4,865,323 | 9/1989 | Heusinkveld | 273/153 S |
| 4,889,340 | 12/1989 | Greene | 273/153 S |
| 5,452,895 | 9/1995 | Ray | 273/153 S |

FOREIGN PATENT DOCUMENTS

| | | | |
|---|---|---|---|
| 1388073 | 4/1988 | U.S.S.R. | 273/153 S |
| 1391673 | 4/1988 | U.S.S.R. | 273/153 S |
| 1719001 | 3/1992 | U.S.S.R. | 273/153 S |

*Primary Examiner*—Steven Wong
*Attorney, Agent, or Firm*—Baker & Daniels

[57] ABSTRACT

A spherical puzzle device having two types of surface members positioned around an inner support sphere, wherein the position of each surface member can be moved to the position of any like member. The device may be divided into three sets of opposing domes, with each set of opposing domes being separated by an equatorial band. Thus, both types of surface members can be repositioned by rotating the opposing domes. Further, the domes may be rotated in increments of ninety degrees, after which a different set of domes may be maneuvered. The present puzzle also includes a structure for complete disassembly and reassembly by the user.

17 Claims, 8 Drawing Sheets

SPHERICAL PUZZLE

BACKGROUND OF THE INVENTION

The present invention relates generally to a spherical puzzle for entertainment and educational purposes.

Spherical puzzles are generally well known in the art, although their modes of operation and complexity differ greatly. For example, U.S. Pat. No. 4,889,340 discloses a spherical puzzle having three circumferential bands of movable surface members disposed in a series of tracks, while the puzzle disclosed in U.S. Pat. No. 4,865,323 has sliding members disposed in a series of latitudinal bands. Still other devices utilize shiftable surface members that slide in one or more tracks surrounding a central sphere.

The prior art devices each have their own limitations. On most of the prior art devices, the moveable puzzle pieces or surface members merely slide in tracks about the central sphere, with much of the surface of the device remaining fixed. On such devices, the complexity of the device is necessarily limited. However, the present invention allows the position of any surface member to be exchanged with the position of any like member. Further, the present device may be divided into three sets of opposing domes separated by an equatorial band, wherein each set of domes is independently rotatable about the three mutually orthogonal axes. Each equatorial band that lies between opposing domes of a given set may rotate with the rotating dome or may remain stationary with the opposing dome while the rotating dome is being moved.

SUMMARY OF THE INVENTION

The present invention allows greater maneuverability of the puzzle pieces or surface members than that found on previous spherical puzzles and also allows a greater number of possible surface member combinations than that afforded by prior art puzzles. Unlike prior art puzzles, the surface members of the present invention can move relative to each other as well as relative to the central support sphere. The surface of the puzzle consists of two types of shiftable surface members. The first type of surface members are substantially spherical triangles in shape, and are curved to conform to the spherical shape of the puzzle. The second type of surface members are square and also curved to conform to the spherical shape of the puzzle, and are arranged in three mutually orthogonal circumferential bands around the surface of the sphere. The combination of the triangular and square shapes serves to provide full surface coverage about the sphere, without gaps in the surface and without requiring the use of stationary polar caps. Consequently, the location of any surface member can be switched with the location of any other like surface member. Further, a surface member located at one of the poles may be moved to a position on the equator or any position in between, or may be moved to a different circumferential band.

Surface members can be shifted around the surface of the puzzle through the use of two types of maneuvers. First, the puzzle pieces that form the circumferential bands may simply be shifted within their tracks around the surface of the puzzle. Also, because the three circumferential bands intersect at six points, the members can easily be shifted from one band to another. Secondly, the puzzle can be divided into three sets of opposing domes rotatable about three mutually orthogonal axes, thus allowing the triangular members to be moved to various points on the surface of the sphere. The square members on the equatorial band that divides the opposing domes may rotate with the moving dome or may remain stationary with the opposing dome. Furthermore, the opposing sets of domes need only rotate ninety (90) degrees before any other set of opposing domes can be maneuvered. Thus, the surface members on a chosen dome may be rotated ninety degrees or more, and then a different set of domes may be rotated about a different axis with a different set of surface members. These steps may be repeated in order to move the triangular members or the square members to numerous different positions on the sphere. Finally, the present invention can be easily assembled and disassembled by the user.

Accordingly, an object of this invention to provide a novel and improved spherical puzzle device.

Another object of this invention is to provide a spherical puzzle device that allows the surface members to be shifted relative to each other as well as relative to the central support sphere.

A further object of this invention is to provide a spherical puzzle device that allows a greater number of possible surface member combinations than prior art puzzles.

A still further object of this invention is to provide a spherical puzzle device that can be easily assembled and disassembled by the user.

Other objects of the invention will become readily apparent to those skilled in the art upon a reading of the following description.

Figures 9, 9A, 10, 11:
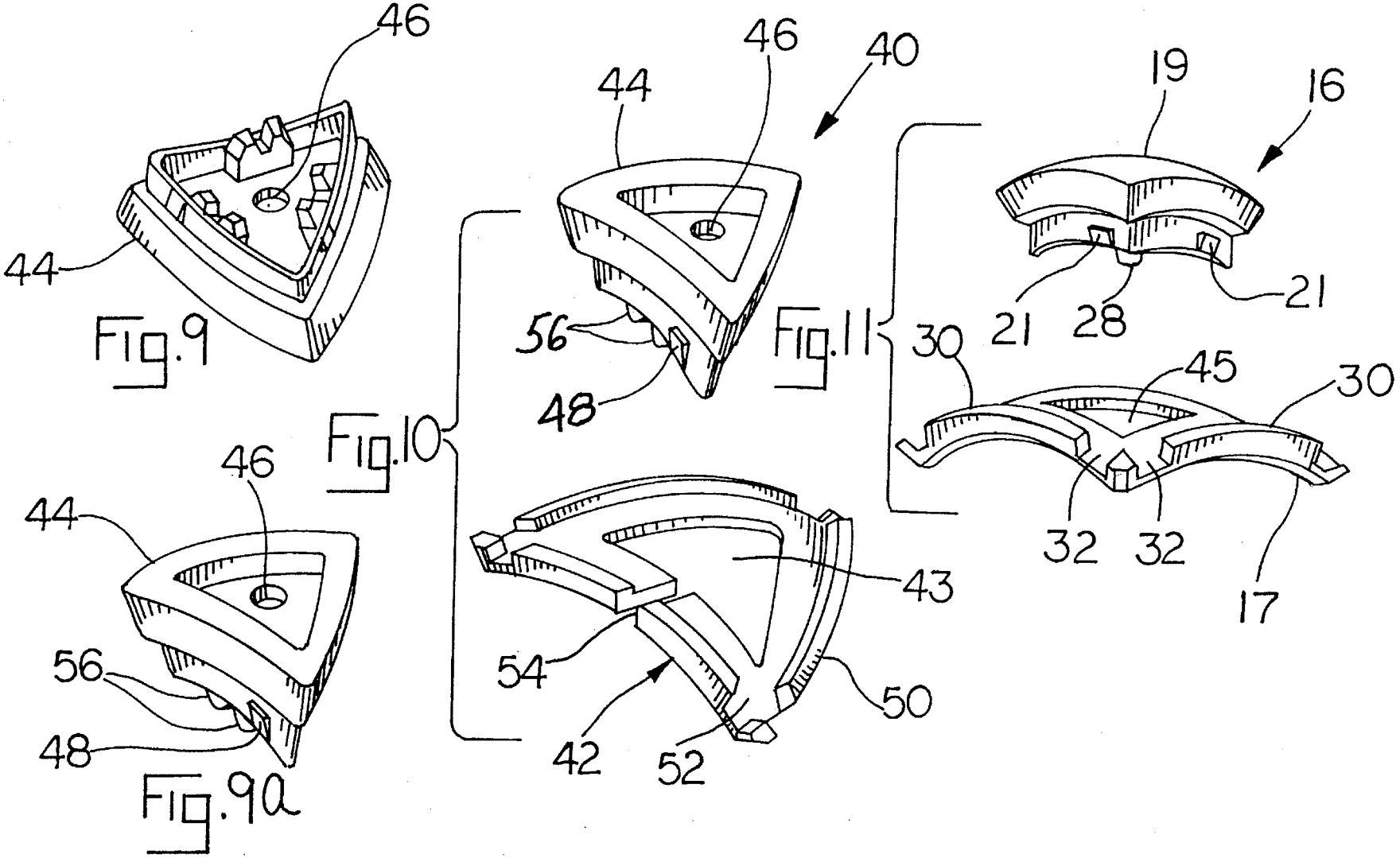
FIG. 9 is a perspective view of the removable plug or anchor member, shown in an inverted position.
Figure 13:
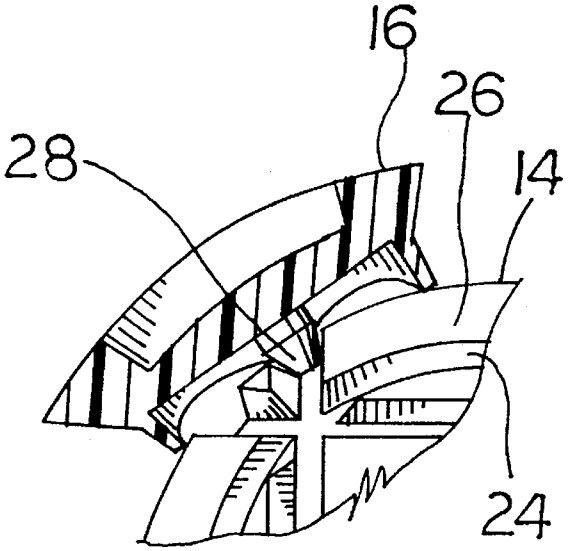
Figure 14:
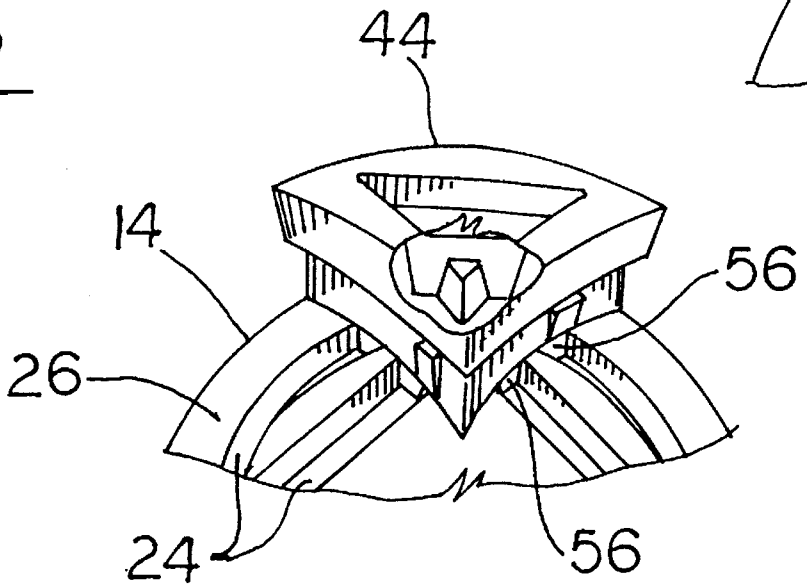
Figure 12:
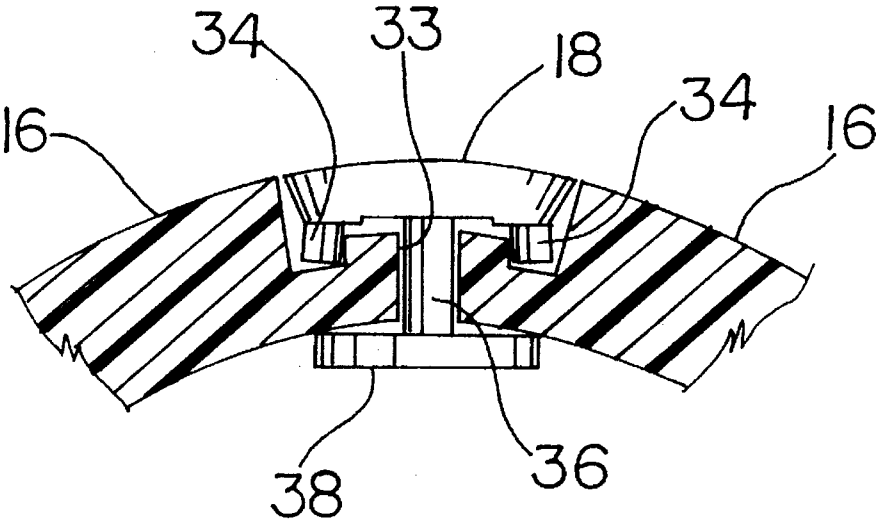

FIG. *9a* is a perspective view of the removable plug of the anchor member shown in FIG. 9, revolved to an upright position;

FIG. 10 is an exploded view in perspective of the removable plug and the slotted portion of the anchor member;

FIG. 11 is an exploded view in perspective of a first surface member;

FIG. 12 is a fragmentary partial cross-sectional view of the second surface member interlocked with two first surface members;

FIG. 13 is a fragmentary partial sectional view of the puzzle device illustrating the inwardly facing projection extending from the first surface member in contact with the guide tracks circumscribing the inner support sphere; and FIG. 14 is a fragmentary view in perspective of the anchor member illustrated in FIGS. 9–10 in place on the inner support sphere and engaging the guide tracks of the inner support sphere, with the slotted portion omitted for clarity.

Figure 15:
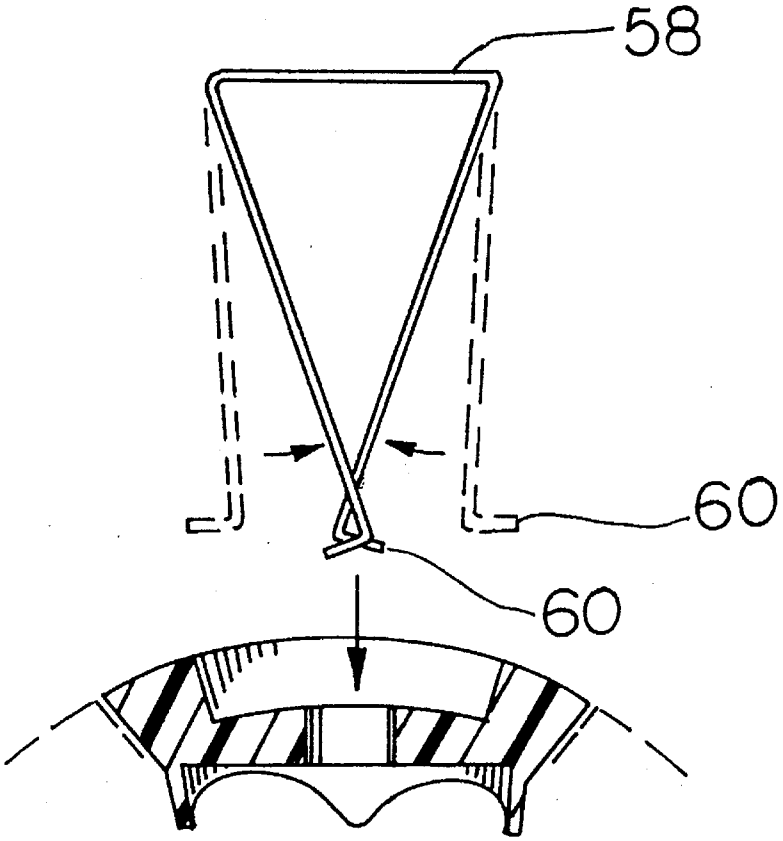

FIG. 15 is a fragmentary partial cross-sectional view of the removable plug of the anchor member illustrating the manner of inserting the removal tool.

Figure 16:
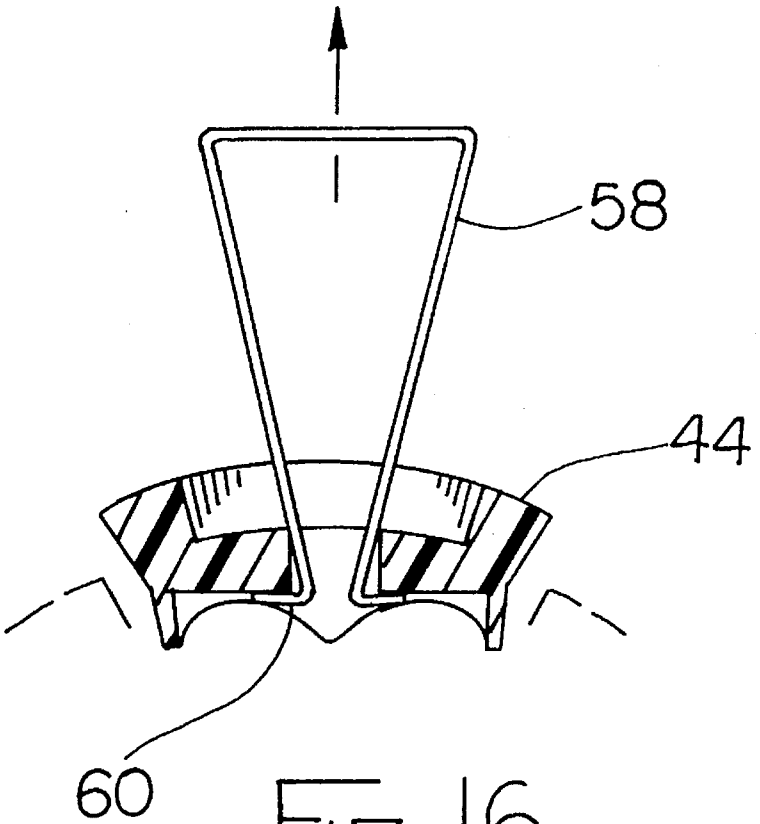

FIG. 16 is a fragmentary partial cross-sectional view of the removable plug and anchor member shown in FIG. 15 illustrating the removal tool engaging the removable plug to disengage the plug from the puzzle.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to best enable others skilled in the art to follow its teachings.

Figure 5:
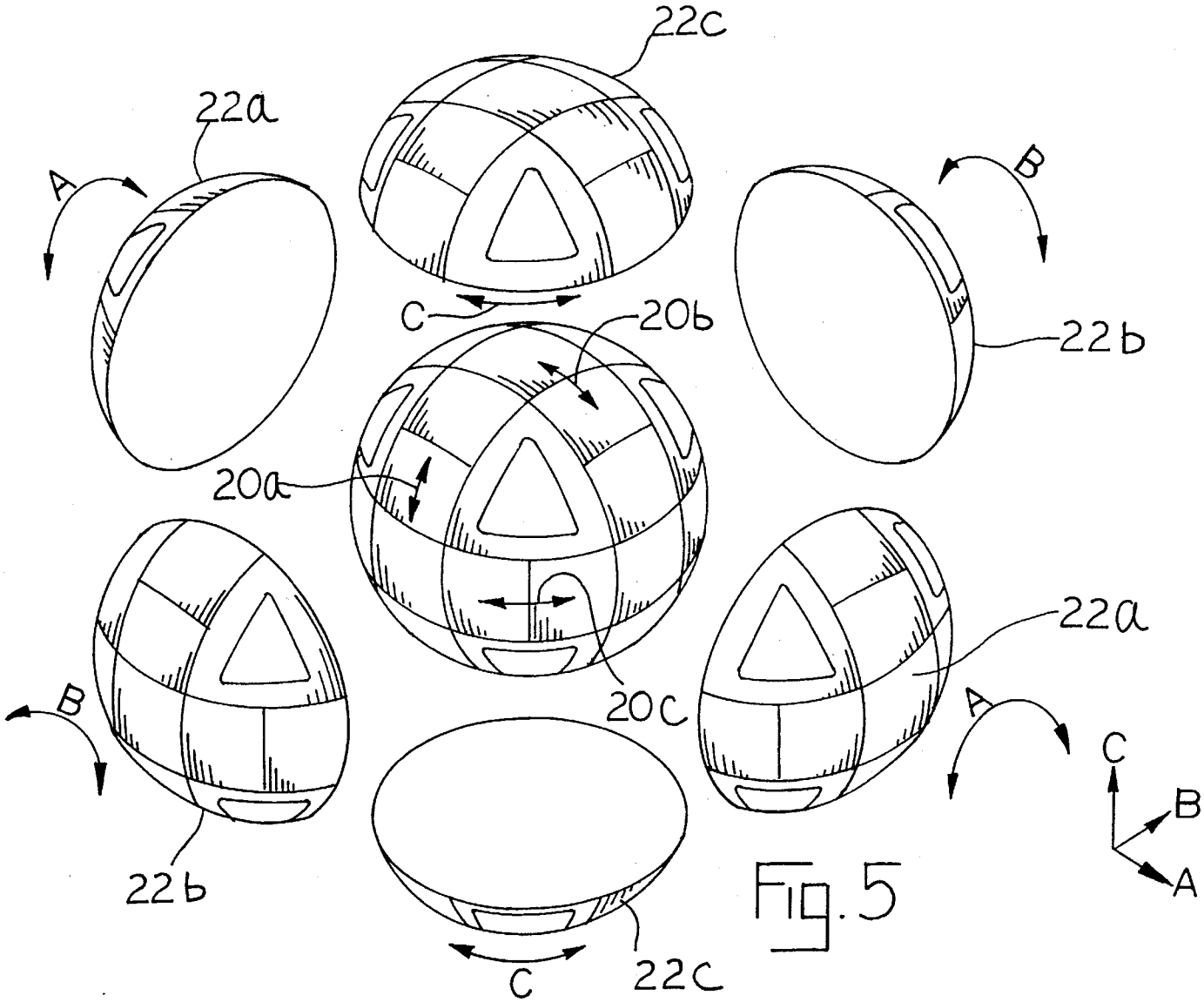
FIG. 5 is an exploded view of the puzzle device of the present invention, illustrating the manner by which the puzzle device may be divided into three sets of opposing domes, each rotatable about three mutually orthogonal axes.

Referring now to the drawings, a spherical puzzle device assembled according to the present invention is generally indicated by the reference numeral 10. The device 10 includes a support sphere 14 surrounded by outer shell 12. Outer shell 12 is comprised of a plurality of triangular first surface members 16 and a plurality of square second surface members 18, with first members 16 and second members 18 having a compound curved outer surface, so that when assembled the members 16, 18 form a sphere. Second surface members 18 are arranged to form three mutually orthogonal circumferential bands 20*a*, 20*b*, and 20*c*, thus dividing the device 10 into three sets of mutually orthogonal opposing domes 22*a*, 22*b*, and 22*c*. Each set of opposing domes 22*a*, 22*b*, and 22*c* is separated by a circumferential equatorial band 20*a*, 20*b*, and 20*c*, respectively. As shown in FIG. 5, the sets of opposing domes overlap, so that any given surface member will simultaneously lie in all three sets of domes. The edges of first members 16 interlock with the edges of second members 18, with first members 16 and second members 18 thus forming a spherical outer shell 12. The second members 18 interlock with first members 16 along their respective edges so that first and second members are slidable relative to each other.

Figure 3:
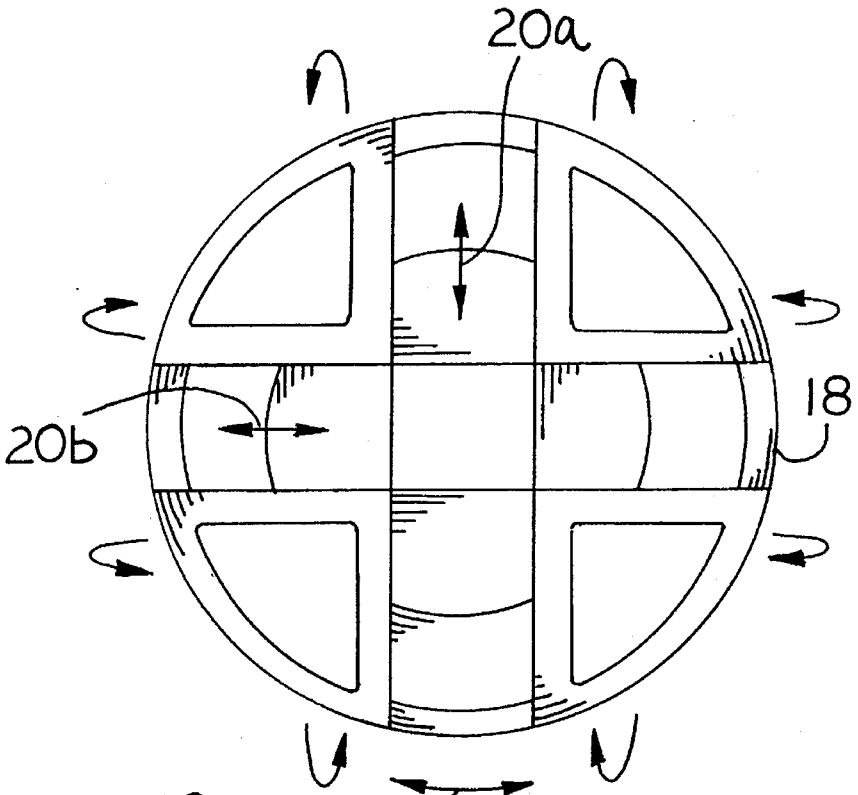
FIG. 3 is a top plan view of the puzzle device shown in FIG. 1.
Figure 1:
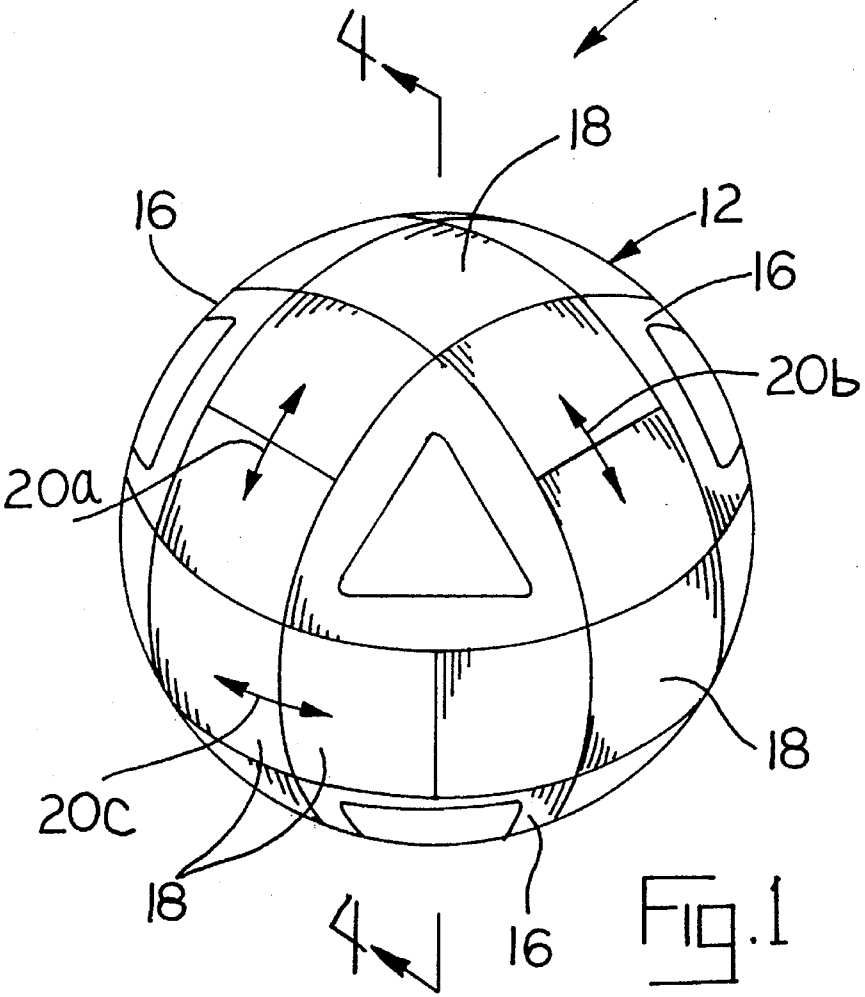
FIG. 1 is a perspective view of a spherical puzzle device according to the present invention.
Figure 2:
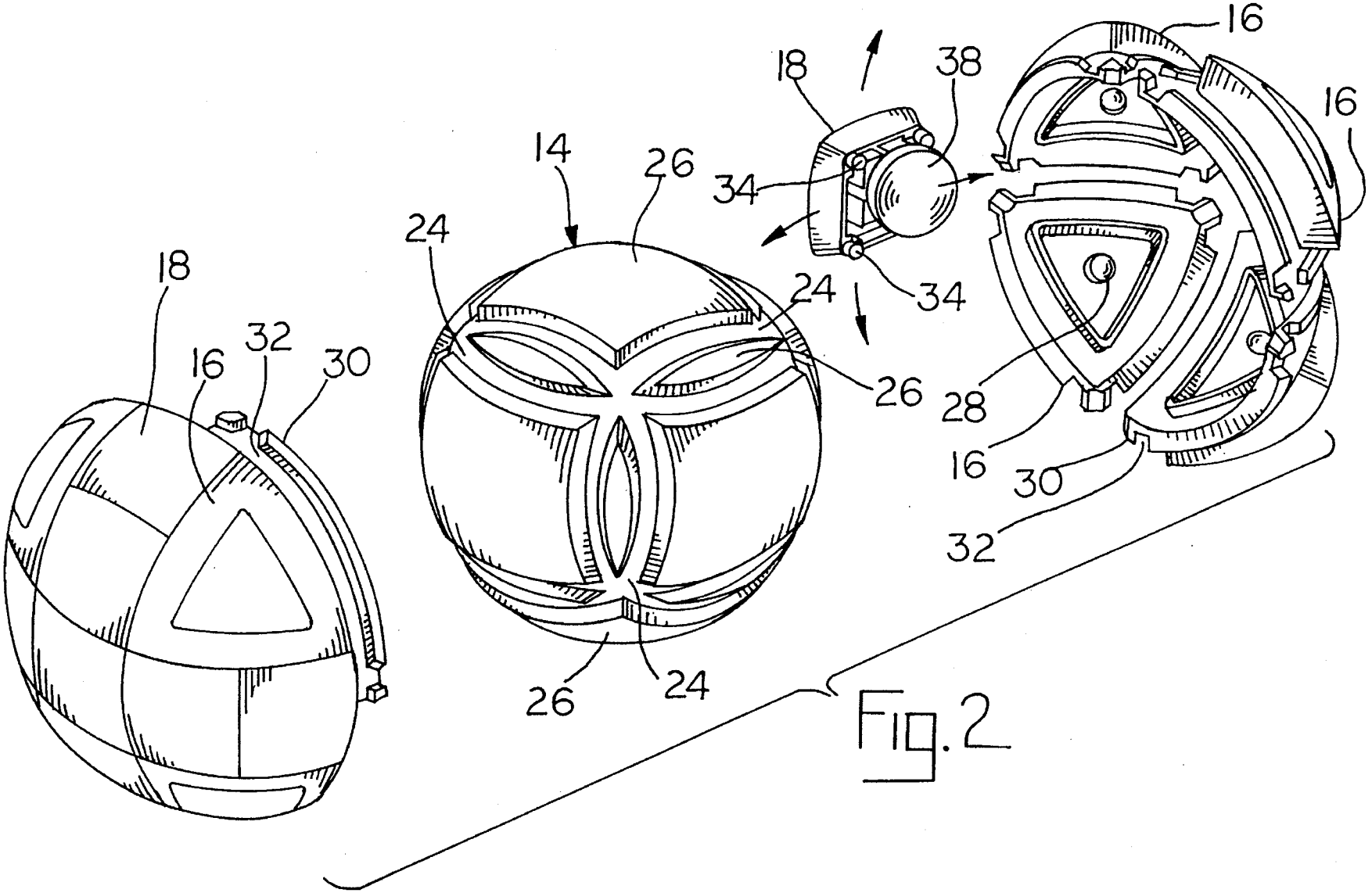
FIG. 2 is an exploded view in perspective of the puzzle device shown in FIG. 1 with some of the components deleted.

As shown in FIG. 2, inner support sphere 14 includes a plurality of guide tracks 24 and support surfaces 26. First surface members 16 include a projection 28 projecting inward from the inner surface of first member 16. As shown to advantage in FIG. 13, projection 28 extends into guide track 24 so that first member 16 is slidable about support sphere 14 following the predetermined paths defined by guide tracks 24. Each edge of each first member 16 includes an upturned flange 30, which defines an interlocking slot 32 along each edge of first member 16. As shown in FIG. 11, first members 16 are comprised of an outer slot part 17 and a central plug part 19 for ease of manufacture. Plug part 19 is inserted into opening 45 in a snap fit connection, and plug 19 includes retention tabs 21 to retain plug part 19 within slot part 17. Projection 28 is formed on plug 19.

Figure 6:
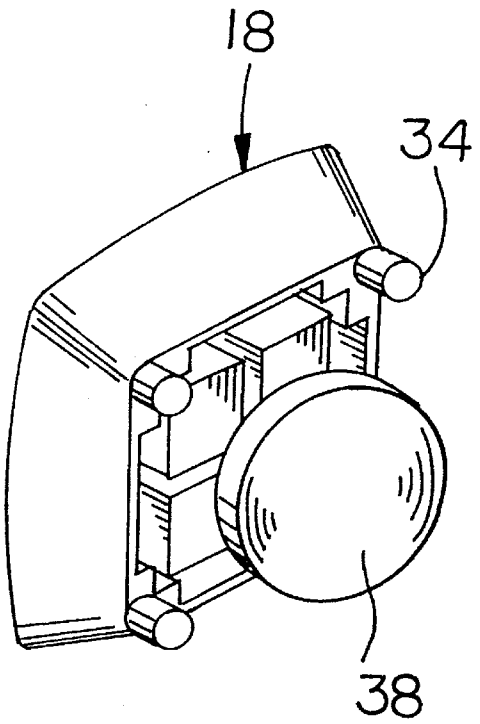
FIG. 6 is a perspective view of one of the second surface members of the present puzzle device.
Figure 8:
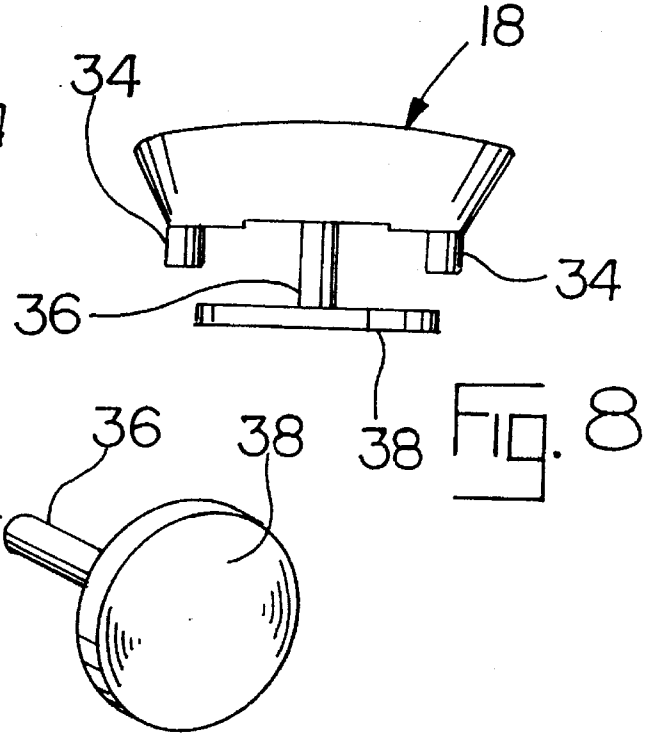
FIG. 8 is a side elevational view of the second surface member shown in FIGS. 6 and 7.
Figure 7:
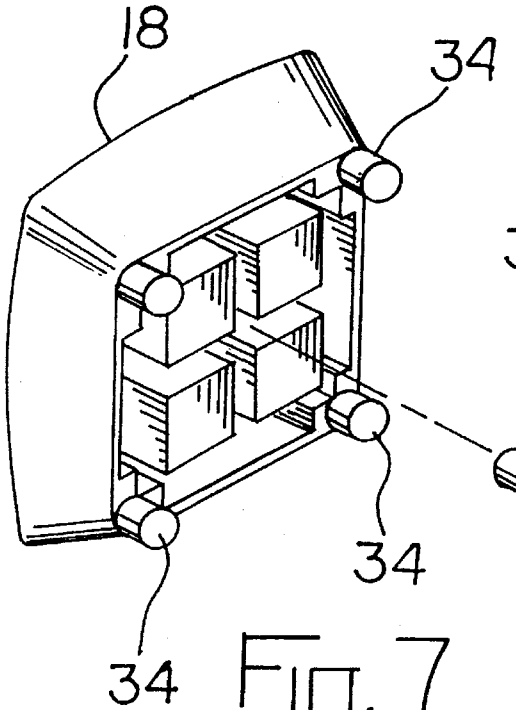
FIG. 7 is an exploded view in perspective of the second surface member shown in FIG. 6.

As shown in greater detail in FIGS. 6–8, second members 18 include a plurality of inwardly facing interlock pegs 34 and a central support post 36 terminating in a terminal pad 38. Terminal pad 38 is a pad that slides along the support surfaces 26 of the support sphere 14. Terminal pad 38 is sized so that pad 38 slides along support surfaces 26 of support sphere 14 and slides over guide tracks 24. Interlock pegs 34 of second members 18 are positioned behind upturned flange 30 of first member 16 to engage interlocking slot 32 on the first member 16. Second members 18 are thus free to slide relative to first member 16, and first members 16 and second members 18 are free to slide relative to support sphere 14. As shown in FIG. 12, adjacent first members define a space 33 into which fits the central support post 36 of second member 18. As shown in FIG. 7, the support post may attach to the second member 18 by a press fit connection for ease of manufacture.

As shown in FIGS. 9 through 10, anchor member 40 includes slot part 42 having a central opening 43 and removable plug 44 for insertion into opening 43. Plug 44 includes extraction hole 46 and retention tabs 48. Plug part 44 is removably inserted into slot part 42 and held in place by retention tabs 48. A removal tool 58 may be inserted into hole 46 in order to disengage plug 44 from slot part 42. Slot part 42 further includes an upturned flange 50 defining an interlocking slot 52 along each edge of anchor member 40. Slot part 42 further includes removal gap 54 that extends through upturned flange 50 and interlocking slot 52. The gap 54 is sized so that the second members 18 can slide through the gap 54 when the plug 44 has been disengaged from the slot part 42. As shown in FIG. 15, removal tool 58 has a pair of hooked ends 60. Hooked ends 60 are squeezed together as shown in FIG. 15 so that ends 60 will fit through hole 46. After insertion, the ends 60 spring apart and tool 58 grasps the inner surface of plug 44 so that plug 44 can be removed.

The underside of plug 44 includes anchor tabs 56. Anchor tabs 56 engage guide tracks 24 so that anchor member 40 and support sphere 14 do not move relative to each other. As shown in FIG. 14 (in which the slot part has been omitted for clarity) anchor tabs 56 of anchor member 40 engage guide tracks 24 on inner support sphere 14 at the intersection of guide tracks 24, and thus prevent anchor member 40 from moving relative to support sphere 14.

Figure 4:
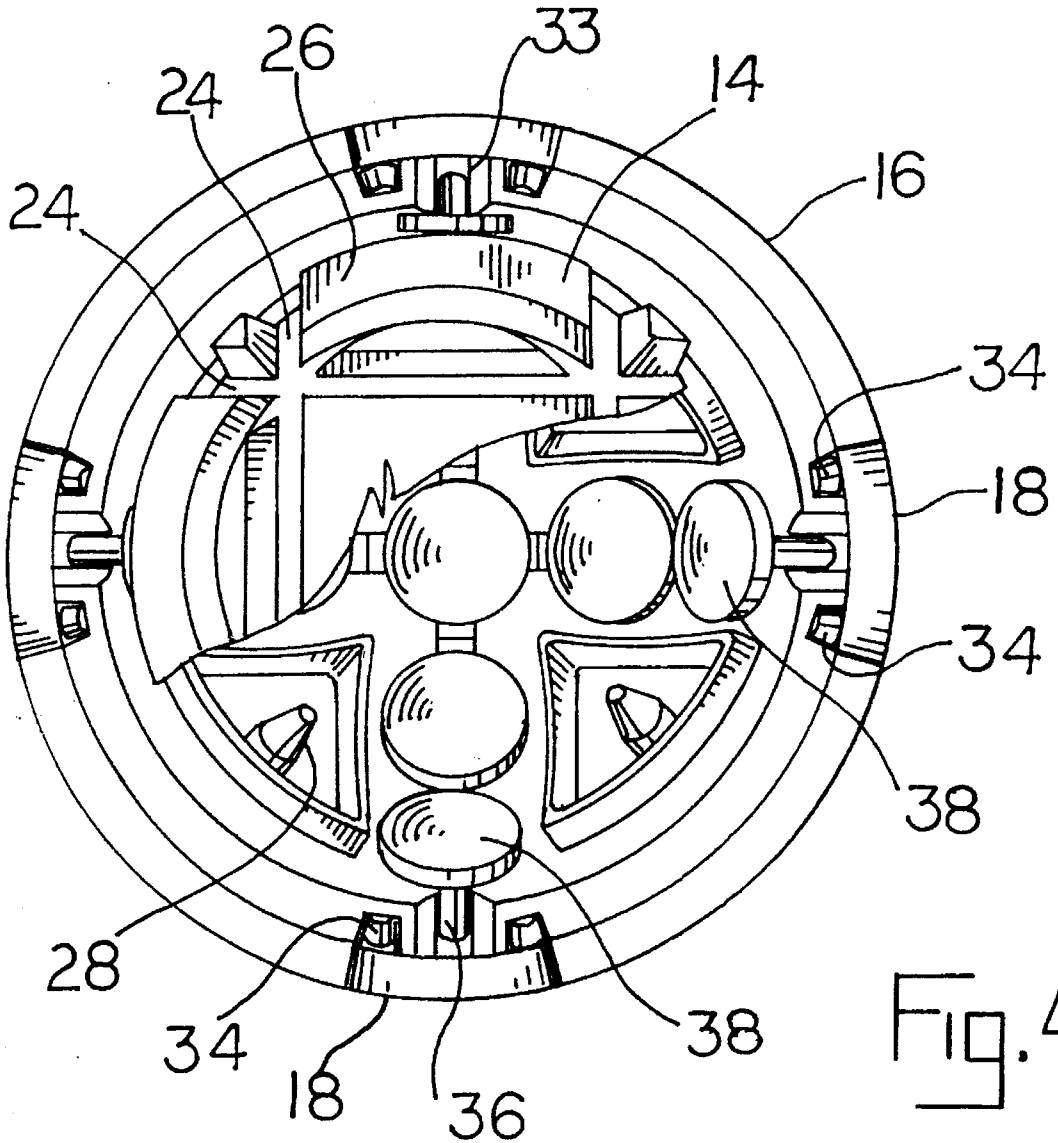
FIG. 4 is a fragmentary cross-sectional view, taken substantially along line 4—4 of FIG. 1.

In operation, the device 10 is assembled substantially as shown in FIGS. 2 and 4. The first members 16 and second members 18 are positioned about the support sphere 14 so that the interlocking pegs 34 of second members 18 engage the interlocking slots 32 of first members 16. During assembly, the projections 28 on first members 16 are positioned to engage guide tracks 24 on support sphere 14, while terminal pads 38 of second members 18 abut the surfaces 26 of support sphere 14. As the outer shell 12 takes shape about the support sphere 14, the last few second members 18 must be inserted into opening 43. With the dome that contains the gap 54 of slot part 42 rotated forty-five (45) degrees, the gap 54 of slot part 42 is aligned with the space 33 between adjacent first members 16, so that the remaining second member 18 can be maneuvered into position. The plug part 44 is then inserted into opening 43 and held in place by retention tabs 48. To disassemble, a special tool (not shown) is inserted into hole 46. The tool engages the inner surface of plug part 44 so that plug part 44 may be pulled out.

The manipulation of the device is as shown in FIG. 5. the device 10 may be divided into three sets of opposing domes 22*a*, 22*b*, and 22*c*. The domes may be rotated in the directions illustrated by arrows A, B, and C, in minimum increments of ninety (90) degrees. The inner support sphere 14 moves along with the dome that contains the anchor member 40, while the opposing dome moves relative to the support sphere. After the dome has been rotated ninety degrees, the device may be then divided into three different sets of opposing domes and rotated once again.

It is understood that the above description does not limit the invention to the above-given details, but may be modified within the scope of the following claims.

I claim:

1. A spherical puzzle comprising a support sphere and an outer spherical shell carried on said support sphere, said shell including multiple surface members movable relative to each other and to said support sphere and an anchor member mounted for movement with said support sphere, said anchor member being moveable with a selected set of said surface members to move said selected set of surface members with said anchor member and with said support sphere relative to the rest of the surface members;

said selected set of surface members being one of multiple sets of surface members movable with said anchor member and wherein said multiple sets of surface members comprise three sets of opposing domes, said opposing domes being rotatable about three mutually orthogonal axes extending through the center of said support sphere;

said multiple surface members including a plurality of first surface members and a plurality of second surface members, said surface members further including interlocking means for joining said first surface members to said second surface members yet allowing relative movement therebetween, said second surface members being square and curved to conform to said inner support sphere, said second surface members arranged to from three mutually orthogonal circumferential bands about said support sphere.

2. A spherical puzzle as claimed in claim 1, wherein rotation of any of said domes in minimum increments of ninety degrees allows any of the remaining said sets of domes to be rotated about the remaining axes.

3. A spherical puzzle as claimed in claim 1, wherein said first surface members are triangular in shape and curved to conform to said inner support sphere.

4. A spherical puzzle as claimed in claim 1, wherein said interlocking means comprises slots along the edges of said first surface members, said slots defined in part by an upturned flange, said interlocking means further including a plurality of projections extending from the inner surface of each of said second surface members, said projections engaging and sliding along said slots on said first surface members.

5. A spherical puzzle as claimed in claim 4, wherein at least one of said projections extending from the inner surface of each of said second surface members includes a terminal pad part, said terminal pad part underlying and engaging the inwardly facing surface of said first surface members, wherein said terminal pad part further abuts and slides along the surface of said support sphere.

6. A spherical puzzle as claimed in claim 1, wherein said support sphere includes a plurality of guide tracks circumscribed thereon, said guide tracks intersecting each other at predetermined intervals, and wherein said first surface members include an inwardly extending projection for coacting with said guide tracks to guide said first surface members relative to said support sphere.

7. A spherical puzzle as claimed in claim 6, wherein said anchor member includes a plurality of inwardly extending projections for mounting said anchor member to said support sphere thereby fixing the position of said anchor member relative to said support sphere.

8. A spherical puzzle as claimed in claim 7, wherein said anchor member includes a slot part surrounding a removable plug part secured within said slot part, said plug part being removable to create an opening exposing a portion of said support sphere, said slot part further defining a gap through said slot part, said gap being exposed upon removal of said plug part, wherein said second surface members are shifted through said gap and into said opening thereby allowing disassembly of said puzzle by allowing said second surface members to be disengaged from said interlocking means and removed from said puzzle.

9. A spherical puzzle comprising a support sphere and an outer spherical shell carried on said support sphere, said shell including multiple surface members movable relative to each other and to said support sphere and an anchor member mounted for movement with said support sphere, said anchor member being moveable with a selected set of said surface members to move said selected set of surface members with said anchor member and with said support sphere relative to the rest of the surface members, and disassembly means for disengaging said anchor member and said surface members from said support sphere;

said disassembly means including a plug part, said plug part being removable from a select one of said surface members to thereby create an opening in said outer spherical shell, said select one of said surface members including a gap therein, said gap being positioned so that after removal of said plug part said surface members are shiftable through said gap and into said opening to thereby disengage said surface members from said outer spherical shell and said support sphere;

said selected set of surface members being one of multiple sets of surface members movable with said anchor member and wherein said multiple sets of surface members comprise three sets of opposing domes, said opposing domes being rotatable about three mutually orthogonal axes extending through the center of said support sphere.

10. A spherical puzzle as claimed in claim 9, wherein rotation of any of said domes in minimum increments of ninety degrees allows any of the remaining said sets of domes to be rotated about the remaining axes.

11. A spherical puzzle as claimed in claim 9, wherein said multiple surface members include a plurality of first surface members and a plurality of second surface members, said surface members further including interlocking means for joining said first surface members to said second surface members yet allowing relative movement therebetween.

12. A spherical puzzle as claimed in claim 11, wherein said first surface members are triangular in shape and curved to conform to said inner support sphere.

13. A spherical puzzle as claimed in claim 11, wherein said second surface members are square and curved to conform to said inner support sphere, said second surface members arranged to form three mutually orthogonal circumferential bands about said support sphere.

14. A spherical puzzle as claimed in claim 11, wherein said interlocking means comprises slots along the edges of said first surface members, said slots defined in part by an upturned flange, said interlocking means further including a plurality of projections extending from the inner surface of each of said second surface members, said projections engaging and sliding along said slots on said first surface members.

15. A spherical puzzle as claimed in claim 14, wherein at least one of said projections extending from the inner surface of each of said second surface members includes a terminal pad part, said terminal pad part underlying and engaging the inwardly facing surface of said first surface members, wherein said terminal pad part further abuts and slides along the surface of said support sphere.

16. A spherical puzzle as claimed in claim 11, wherein said support sphere includes a plurality of guide tracks circumscribed thereon, said guide tracks intersecting each other at predetermined intervals, and wherein said first surface members include an inwardly extending projection for coacting with said guide tracks to guide said first surface members relative to said support sphere.

17. A spherical puzzle as claimed in claim 16, wherein said anchor member includes a plurality of inwardly extending projections for mounting said anchor member to said support sphere thereby fixing the position of said anchor member relative to said support sphere.

* * * * *